US008210715B2

(12) United States Patent
Mostoller et al.

(10) Patent No.: US 8,210,715 B2
(45) Date of Patent: Jul. 3, 2012

(54) SOCKET ASSEMBLY WITH A THERMAL MANAGEMENT STRUCTURE

(75) Inventors: Matthew Edward Mostoller, Hummelstown, PA (US); Christopher George Daily, Harrisburg, PA (US); Charles Raymond Gingrich, III, Mechanicsburg, PA (US); Ronald Martin Weber, Annville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 289 days.

(21) Appl. No.: 12/634,542

(22) Filed: Dec. 9, 2009

(65) Prior Publication Data

US 2011/0136374 A1 Jun. 9, 2011

(51) Int. Cl.
*F21S 4/00* (2006.01)
*F21V 21/00* (2006.01)

(52) U.S. Cl. ..... 362/249.02; 362/294; 362/311.02; 362/646; 362/800

(58) Field of Classification Search ..... 362/249.02, 362/294, 311.02, 368–369, 373, 545, 547, 362/646, 800; 439/56
See application file for complete search history.

(56) References Cited

U.S. PATENT DOCUMENTS

| | | | | |
|---|---|---|---|---|
| 5,038,255 | A | 8/1991 | Nishihashi et al. | |
| 5,283,716 | A | 2/1994 | Banitt et al. | |
| 5,404,282 | A | 4/1995 | Klinke et al. | |
| 5,660,461 | A | 8/1997 | Ignatius et al. | |
| 6,318,886 | B1 | 11/2001 | Stopa et al. | |
| 6,541,800 | B2 | 4/2003 | Barnett et al. | |
| 6,667,544 | B1 | 12/2003 | Glenn | |
| 6,817,735 | B2 | 11/2004 | Shimizu et al. | |
| 6,911,731 | B2 | 6/2005 | Wu | |
| 6,999,318 | B2 | 2/2006 | Newby | |
| 7,306,353 | B2 | 12/2007 | Popovich et al. | |
| 7,322,718 | B2 | 1/2008 | Setomoto et al. | |
| 7,344,296 | B2 * | 3/2008 | Matsui et al. | 362/652 |
| 7,348,604 | B2 | 3/2008 | Matheson | |
| 7,400,029 | B2 | 7/2008 | Shimada et al. | |
| 7,540,761 | B2 | 6/2009 | Weber et al. | |
| 7,549,786 | B2 | 6/2009 | Higley et al. | |
| 7,553,162 | B2 | 6/2009 | Isoda et al. | |
| 2002/0113244 | A1 | 8/2002 | Barnett et al. | |
| 2002/0114155 | A1 | 8/2002 | Katogi et al. | |
| 2002/0176250 | A1 | 11/2002 | Bohler et al. | |
| 2003/0063463 | A1 | 4/2003 | Sloan et al. | |
| 2003/0094893 | A1 | 5/2003 | Ellens et al. | |
| 2003/0112627 | A1 | 6/2003 | Deese | |

(Continued)

FOREIGN PATENT DOCUMENTS

| | | |
|---|---|---|
| DE | 19818402 | 10/1999 |

(Continued)

*Primary Examiner* — Jason Moon Han

(57) ABSTRACT

A socket assembly includes a lighting package and a socket housing having a receptacle that removably receives the lighting package. A thermal management structure is coupled to the socket housing and is positioned at the receptacle in thermal engagement with the lighting package. The thermal management structure is configured to engage a heat sink to dissipate heat from the lighting package to the heat sink. Optionally, at least one of the socket housing and the thermal management structure may have mounting features configured to mount the socket assembly to a heat sink, where the lighting package is removable from the receptacle while the socket assembly remains mounted to the heat sink. The thermal management structure may be coupled to the socket housing such that the thermal management structure and the socket housing are coupled to a heat sink as a unit.

16 Claims, 7 Drawing Sheets

U.S. PATENT DOCUMENTS

| | | | |
|---|---|---|---|
| 2003/0189829 | A1 | 10/2003 | Shimizu et al. |
| 2004/0175189 | A1 | 9/2004 | Weber-Rabsilber et al. |
| 2004/0252501 | A1 | 12/2004 | Moriyama et al. |
| 2004/0264195 | A1 | 12/2004 | Chang et al. |
| 2005/0152146 | A1 | 7/2005 | Owen et al. |
| 2005/0243558 | A1 | 11/2005 | Van Duyn |
| 2006/0091410 | A1 | 5/2006 | Chen |
| 2006/0262533 | A1 | 11/2006 | Lin et al. |
| 2007/0025103 | A1 | 2/2007 | Chan |
| 2007/0246712 | A1 | 10/2007 | Kim et al. |
| 2008/0220631 | A1 | 9/2008 | Isoda et al. |
| 2008/0315214 | A1 | 12/2008 | Wall, Jr. et al. |
| 2009/0009103 | A1 | 1/2009 | McKechnie et al. |
| 2009/0009998 | A1 | 1/2009 | Malstrom et al. |
| 2009/0108281 | A1 | 4/2009 | Keller et al. |
| 2009/0130889 | A1 | 5/2009 | Daily et al. |
| 2009/0146919 | A1 | 6/2009 | Kline et al. |

FOREIGN PATENT DOCUMENTS

| | | |
|---|---|---|
| DE | 10319525 | 11/2004 |
| EP | 1098135 | 5/2001 |
| WO | WO 01/73844 | 10/2001 |

* cited by examiner

SOCKET ASSEMBLY WITH A THERMAL MANAGEMENT STRUCTURE

CROSS REFERENCE TO RELATED APPLICATIONS

This Application Relates to U.S. patent application titled SOLID STATE LIGHTING ASSEMBLY, application Ser. No, 12/634,417, U.S. patent application titled LED SOCKET ASSEMBLY, application Ser. No. 12/634,453, U.S. patent application titled SOLID STATE LIGHTING SYSTEM, application Ser. No. 12/634,492, and U.S. patent application titled LED SOCKET ASSEMBLY, application Ser. No. 12/634,517, each filed concurrently herewith, the subject matter of each of which are herein incorporated by reference in their entirety.

BACKGROUND OF THE INVENTION

The subject matter herein relates generally to solid state lighting assemblies, and more particularly, to socket assemblies for solid state lighting systems with thermal management structures.

Solid-state light lighting systems use solid state light sources, such as light emitting diodes (LEDs), and are being used to replace other lighting systems that use other types of light sources, such as incandescent or fluorescent lamps. The solid-state light sources offer advantages over the lamps, such as rapid turn-on, rapid cycling (on-off-on) times, long useful life span, low power consumption, narrow emitted light bandwidths that eliminate the need for color filters to provide desired colors, and so on.

LED lighting systems typically include LEDs soldered down to a printed circuit board (PCB). The PCB then is mechanically and electrically attached to a heat sink of the lighting fixture. Wires are soldered to the PCB to provide an electrical connection. In known LED lighting systems, mechanical hardware may be used to physically secure the PCB to the heat sink. In addition to the mechanical fixturing, a thermal grease, thermal pad, or thermal epoxy is typically provided at the interface between the PCB and the heat sink. These systems are not without disadvantages. For instance, the thermal interface products are difficult to work with and, in some situations, do not provide sufficient heat transfer. Additionally, problems arise when the LEDs or the PCB needs to be replaced in the future. The rework process is tedious and may require a skilled person to perform the removal and replacement. Additionally, the PCB typically includes many LEDs thereon, and if one of the LEDs malfunctions or does not work, then the entire PCB may need to be replaced.

A need remains for a lighting system that may be efficiently packaged into a lighting fixture. A need remains for a lighting system that may be efficiently configured for an end use application.

BRIEF DESCRIPTION OF THE INVENTION

In one embodiment, a socket assembly is provided that includes a lighting package being powered and generating heat and a socket housing having a receptacle that removably receives the lighting package. A thermal management structure is coupled to the socket housing and is positioned at the receptacle in thermal engagement with the lighting package. The thermal management structure is configured to engage a heat sink to dissipate heat from the lighting package to the heat sink. Optionally, at least one of the socket housing and the thermal management structure may have mounting features configured to mount the socket assembly to a heat sink, where the lighting package is removable from the receptacle while the socket assembly remains mounted to the heat sink. The thermal management structure may be coupled to the socket housing such that the thermal management structure and the socket housing are coupled to a heat sink as a unit.

In another embodiment, a socket assembly is provided including a first socket and a second socket. The first socket includes a first socket housing having a first receptacle and a first connector. The first socket has a first lighting package removably received in the first receptacle and electrically connected to the first connector. The first socket also has a first thermal management structure coupled to the first socket housing, where the first thermal management structure is positioned at the first receptacle in thermal engagement with the first lighting package. The second socket has a second socket housing having a second receptacle and a second connector and a second lighting package removably received in the second receptacle and electrically connected to the second connector. The second socket also has a second thermal management structure coupled to the second socket housing, where the second thermal management structure is positioned at the second receptacle in thermal engagement with the second lighting package. The first and second sockets are ganged together such that the first and second connectors are electrically connected to one another to transfer power between the first and second sockets.

In a further embodiment, a socket assembly is provided including a lighting package having an lighting printed circuit board (PCB) with a power circuit having a power contact, where the power contact is configured to receive power from a power source to power the power circuit. The socket assembly also having a thermal management structure defining a socket housing having a receptacle that removably receives the lighting package. The thermal management structure has a mating interface in thermal engagement with the lighting package.

DETAILED DESCRIPTION OF THE INVENTION

Figure 1:
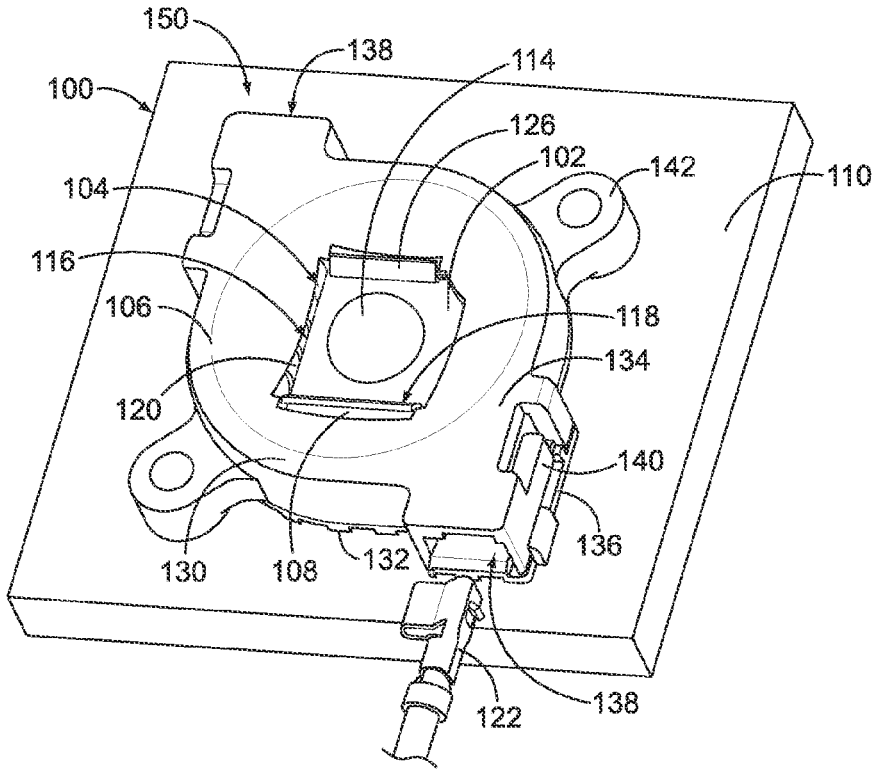
FIG. 1 is a top perspective view of a socket assembly formed in accordance with an exemplary embodiment.
Figure 2:
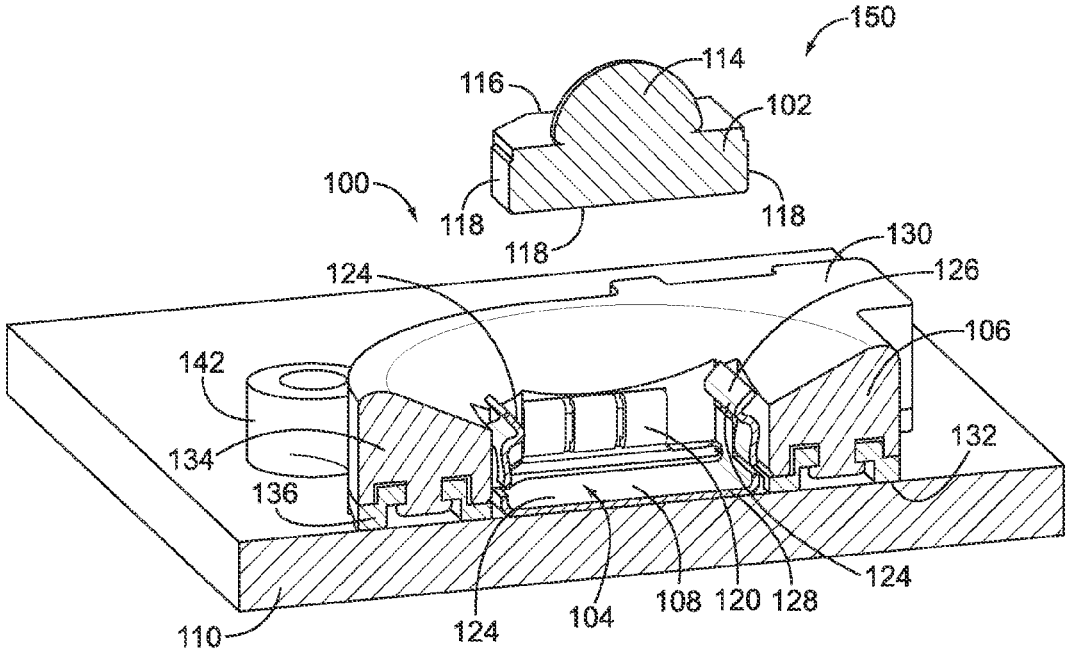
FIG. 2 is a partial cutaway view of the socket assembly shown in FIG. 1.

FIG. 1 is a top perspective view of a socket assembly 100 formed in accordance with an exemplary embodiment. FIG. 2 is a partial cutaway view of the socket assembly 100. The assembly 100 is part of a light engine that is used for residential, commercial or industrial use. The assembly 100 may be used for general purpose lighting, or alternatively, may have a customized application or end use.

The assembly 100 includes a lighting package 102 that is removably received in a receptacle 104 of a socket housing 106. A thermal management structure 108 is coupled to the socket housing 106 and is positioned at the receptacle 104 in thermal engagement with the lighting package 102. The thermal management structure 108 is configured to engage a heat sink 110 to dissipate heat from the lighting package 102 to the heat sink 110.

The lighting package 102 includes a solid state lighting device, represented in FIGS. 1 and 2 by a light emitting diode (LED) 114. The LED 114 includes an electrical power interface 116 and a thermal interface 118. The power interface 114 engages power contacts 120 held by the socket housing 106. Power is transferred across the power interface 116 to power the LED 114. Power is supplied to the power contacts 120 by a power connector 122 that is coupled to the socket housing 106. In an exemplary embodiment, power interfaces 116 are provided on opposite edges of the LED 114, which interface with power contacts 120 on opposites sides of the receptacle 104. Two power connectors 122 are coupled to the socket housing 106, which engage corresponding sets of the power contacts 120.

The thermal interface 118 engages the thermal management structure 108. In an exemplary embodiment, the thermal interface 118 extends along opposite edges of the LED 114 and along the bottom of the LED 114. The thermal management structure 108 engages both the edges and the bottom to dissipate heat from the LED 114. The thermal interface 118 may be characterized as having a high thermal conductivity to facilitate good heat transfer at the thermal interface 118. For example, the thermal interface 118 may be plated with a metal material.

The thermal management structure 108 includes a mating interface 124 that engages the thermal interface 118 of the LED 114. In an exemplary embodiment, the thermal management structure 108 is manufactured from a metal material, such as copper, aluminum, a metal alloy, and the like. The thermal management structure 108 includes compliant beams 126 that engage the LED 114. The compliant beams 126 ensure good thermal contact between the thermal interface 118 and the mating interface 124. Optionally, the compliant beams 126 may define latches to secure the LED 114 within the receptacle 104, and thus may be referred to hereinafter as latches 126. The latches 126 engage a top surface of the LED 114 to hold the LED 114 within the receptacle 104. The latches 126 force the LED 114 downward within the receptacle 104 into engagement with a base 128 of the thermal management structure 108. The base 128 thermally engages the bottom of the LED 114 to facilitate thermal transfer of heat from the LED 114 to the thermal management structure 108, and ultimately to the heat sink 110.

The socket housing 106 includes a top 130 and a bottom 132. The top 130 is open and is configured to receive the lighting package 102 therethrough into the receptacle 104. The bottom 132 may rest on a support structure, such as the heat sink 110 or another structure of the lighting fixture. The bottom 132 is open below the receptacle 104 such that the lighting package 102 may rest on the thermal management structure 108. In the illustrated embodiment, the socket housing 106 includes an upper housing 134 and a lower housing 136 coupled together.

The power contacts 120 are held between the upper and lower housings 134, 136, and may be loaded between the upper and lower housings 134, 136 prior to coupling the upper and lower housings 134, 136 together. As such, the power contacts 120 may be held internal to the socket housing 106. The power contacts 120 are positioned such that the power contacts 120 are exposed to the receptacle 104. As such, when the LED 114 is loaded into the receptacle 104, the power contacts 120 engage the LED 114.

The socket housing 106 includes connector ports 138 that receive the power connectors 122. The power contacts 120 may be exposed within the connector ports 138 such that the power connectors 122 engage the power contacts 120 when the power connectors 122 are loaded into the connector ports 138. The socket housing 106 may include securing features 140 at the connector ports 138 to hold the power connectors 122 within the connector ports 138.

The socket housing 106 includes mounting features 142 used to secure the socket housing 106 to the heat sink 110. For example, the mounting features 142 may include openings that receive fasteners (not shown). Alternative types of mounting features may be used in alternative embodiments, such as clips.

When assembled, the LED package 102, the socket housing 106, and the thermal management structure 108 together define an individual socket 150 of the assembly 100. Any number of sockets 150 may be combined to form the assembly 100. For example, the sockets 150 may be ganged together or may be daisy-chained together. The sockets 150 may be physically connected together in addition to being electrically connected together. The sockets 150 may be assembled together prior to being mounted to the heat sink 110. For example, the thermal management structure 108 may be coupled to the socket housing 106, and then the lighting package 102 loaded into the receptacle 104. Once assembled, the socket 150 may be handled as a single unit, and moved to the appropriate location on the heat sink 110 and mounted thereto. As a result, the thermal management structure 108 is an integral part of the socket 150 and may be mounted to the heat sink 110 during the same mounting step as the socket housing 106. Once mounted, the thermal management structure 108 engages the heat sink 110 and defines the thermal path between the lighting package 102 and the heat sink 110. Optionally, the thermal management structure 108 may be used as the only thermal interface between the sockets 150 and the heat sink 110. No other thermal interconnect is required. For example, no thermal grease, thermal epoxy or thermal pad need be positioned between the lighting package 102 and the heat sink 110. The socket 150 may be quickly mounted to the heat sink 110. The socket 150 is easy and clean to handle and work with. The socket 150 may be easily repaired and replaced, such as by removing the socket 150 from the heat sink 110, and without thermal grease or epoxy between the socket 150 and the heat sink 110, the removal is clean and easy. Alternatively, just the lighting package 102 may be removed from the receptacle 104, while the socket housing 106 and thermal management structure 108 remain in place, mounted to the heat sink 110. As such, the lighting packages 102 (e.g. to replace a defective or burnt out LED 114, for a different lighting effect, and the like) may be removed from the receptacle 104 and replaced with a different lighting package 102.

Figure 3:
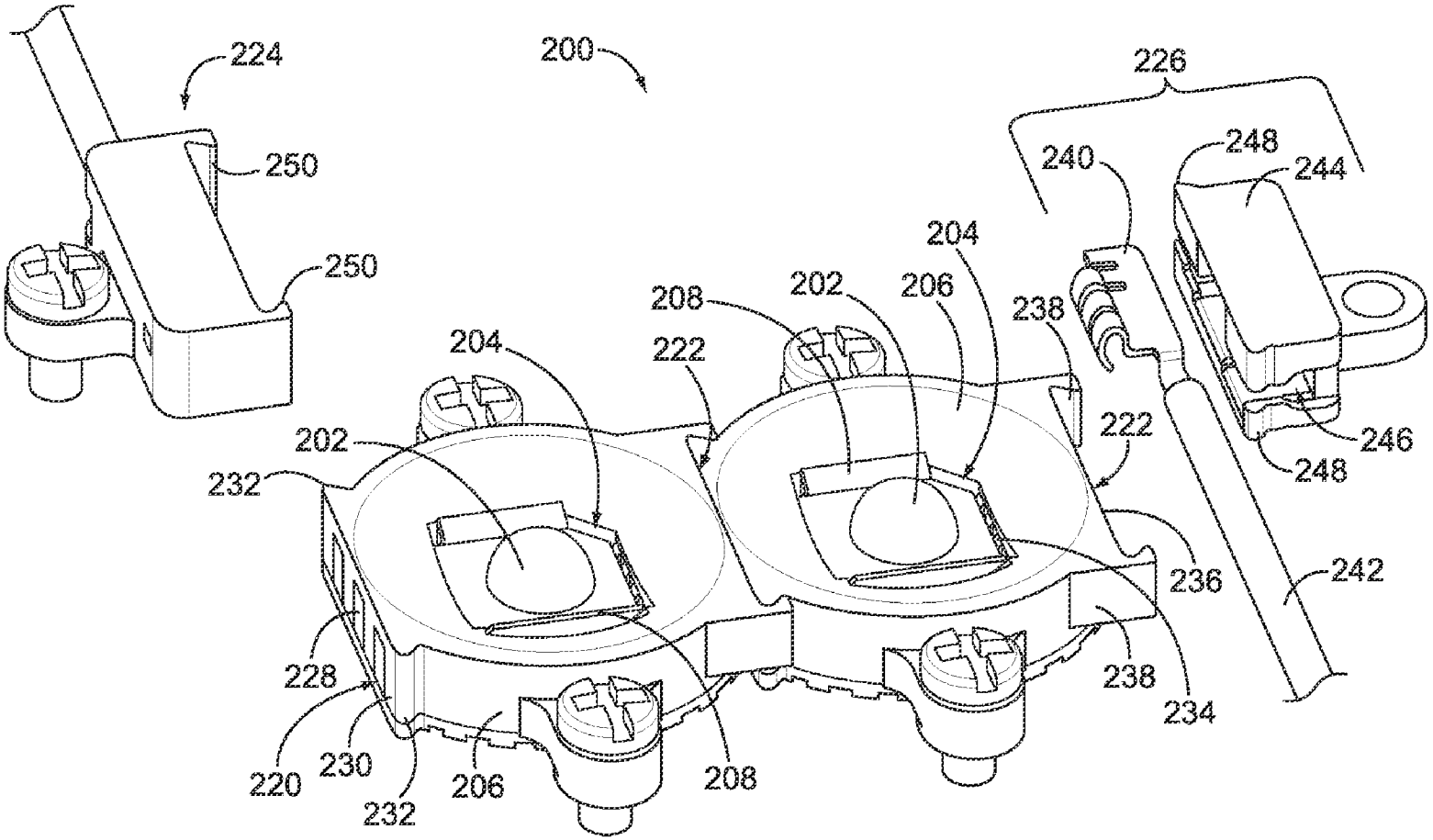
FIG. 3 is a top perspective view of an alternative socket assembly formed in accordance with an exemplary embodiment.

FIG. 3 is a top perspective view of an alternative socket assembly 200 formed in accordance with an exemplary embodiment. The assembly 200 includes a lighting package 202 that is removably received in a receptacle 204 of a socket housing 206. A thermal management structure 208 is coupled to the socket housing 206 and is positioned at the receptacle 204 in thermal engagement with the lighting package 202. The thermal management structure 208 is configured to engage a heat sink (not shown) to dissipate heat from the lighting package 202 to the heat sink. The lighting package 202 and thermal management structure 208 are similar to the lighting package 102 and thermal management structure 108 (both shown in FIGS. 1 and 2), however the socket housing 206 differs from the socket housing 106 (shown in FIGS. 1 and 2). The LED package 202, the socket housing 206, and the thermal management structure 208 together define an individual socket 210 of the assembly 200. Any number of sockets 210 may be combined to form the assembly 200. In the illustrated embodiment, two sockets 210 are ganged together, such that the sockets 210 are mechanically and electrically coupled to one another.

The socket housing 206 includes a first connector 220 and a second connector 222 at opposite ends of the socket housing 206. The first and second connectors 220, 222 are configured to engage connectors 222, 220, respectively of an adjacent socket 210. The first and second connectors 220, 222 are also configured to engage power connectors 224, 226. As such, individual sockets 210 may be ganged together, with the power connectors 224, 226 being coupled to the outermost connectors 220, 222, respectively. As such, a modular system is provided, with individual sockets 210 being arranged end-to-end in series. Power is transferred between the connectors 220, 222 of adjacent sockets 210.

The first connector 220 includes power contacts 228 that are exposed at a first edge 230 of the socket housing 206 and that are exposed within the receptacle 204. The lighting package 202 engages the power contacts 228. Either the first power connector 224 or a second connector 222 of an adjacent socket 210 is configured to engage the power contacts 228 at the edge 230. The first connector 220 includes securing features 232 for securing the first power connector 224 or the second connector 222 to the first connector 220. In the illustrated embodiment, the securing features 232 represent protrusions.

The second connector 222 includes power contacts 234 that are exposed at a second edge 236 of the socket housing 206 and that are exposed within the receptacle 204. The lighting package 202 engages the power contacts 234. Either the second power connector 226 or a first connector 220 of an adjacent socket 210 is configured to engage the power contacts 234 at the edge 236. The second connector 222 includes securing features 238 for securing the second power connector 226 or the first connector 220 to the second connector 222. In the illustrated embodiment, the securing features 238 represent pockets that receive the protrusions of the securing features 232.

The second power connector 226 includes a contact 240 terminated to an end of a wire 242. The second power connector 226 also includes a body 244 having a channel 246 that receives the contact 240 and wire 242. The contact 240 is exposed along an edge of the body 244 for mating with the power contacts 234 of the second connector 222. The body 244 includes securing features 248 that are configured to engage the securing features 238 of the second connector 222 to securely couple the second power connector 226 to the second connector 222. In the illustrated embodiment, the securing features 248 represent protrusions that are received in the pockets of the securing features 238.

The first power connector 224 is similar to the second power connector 226, however the first power connector 224 includes securing features 250 that are configured to engage the securing features 232 of the first connector 220 to securely couple the first power connector 224 to the first connector 220. In the illustrated embodiment, the securing features 250 represent pockets that receive the protrusions of the securing features 232.

The sockets 210 may be assembled together prior to being mounted to the heat sink. For example, the thermal management structure 208 may be coupled to the socket housing 206, and then the lighting package 202 loaded into the receptacle 204. Once assembled, the socket 210 may be handled as a single unit, and moved to the appropriate location on the heat sink and mounted thereto. As a result, the thermal management structure 208 is an integral part of the socket 210 and may be mounted to the heat sink during the same mounting step as the socket housing 206. Once mounted, the thermal management structure 208 engages the heat sink and defines the thermal path between the lighting package 202 and the heat sink. The power connectors 224, 226 may be connected to the sockets 210 either before or after the sockets 210 are mounted to the heat sink.

Figure 4:
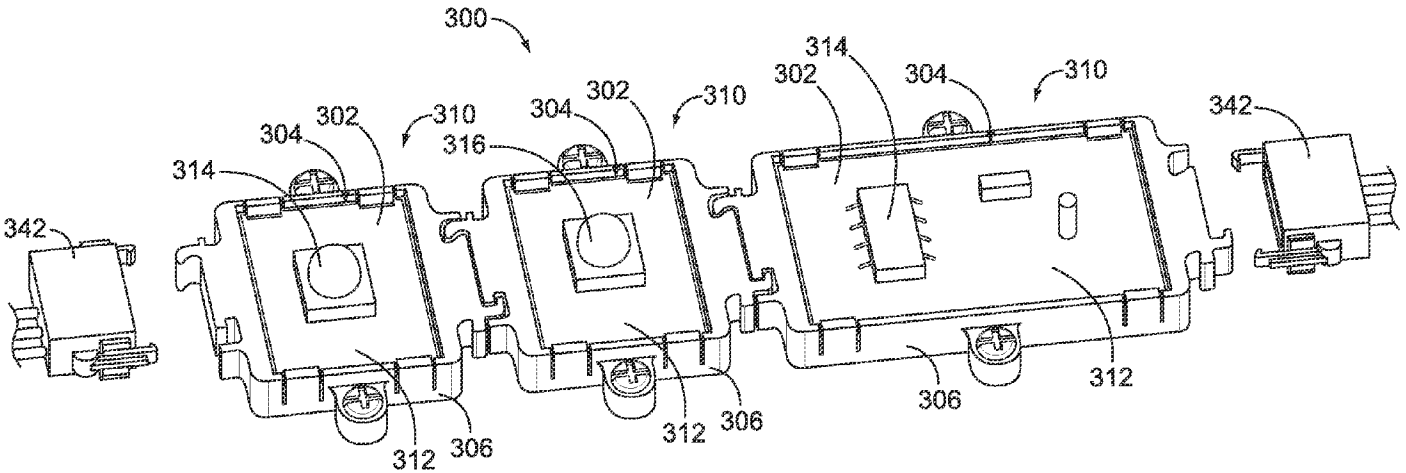
FIG. 4 is a top perspective view of another alternative socket assembly formed in accordance with an exemplary embodiment.
Figure 5:
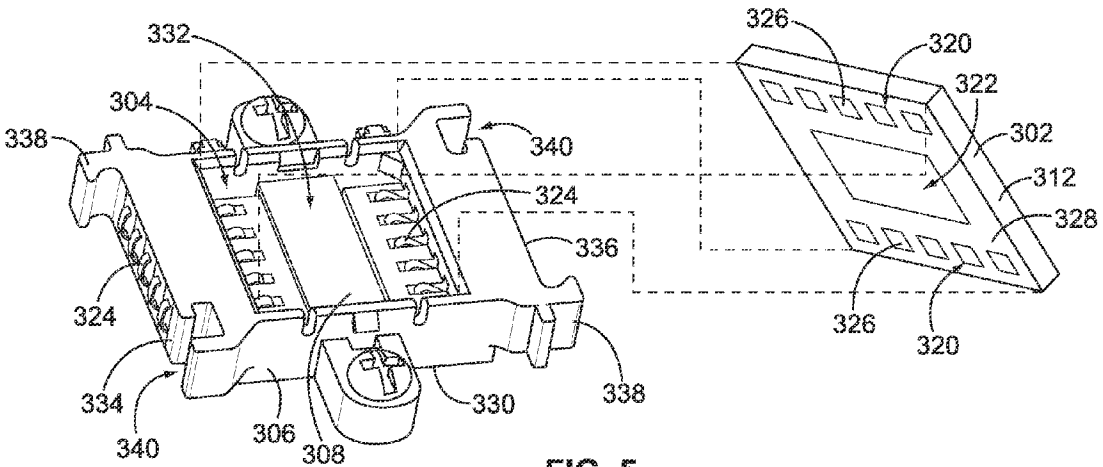
FIG. 5 is a top perspective view of a socket housing and thermal management structure for the socket assembly shown in FIG. 4.

FIG. 4 is a top perspective view of another alternative socket assembly 300 formed in accordance with an exemplary embodiment. FIG. 5 is an exploded view of a portion of the socket assembly 300. The assembly 300 includes a lighting package 302 that is removably received in a receptacle 304 of a socket housing 306. A thermal management structure 308 (shown in FIG. 5) is coupled to the socket housing 306 and is positioned at the receptacle 304 in thermal engagement with the lighting package 302. The thermal management structure 308 is configured to engage a heat sink (not shown) to dissipate heat from the lighting package 302 to the heat sink.

The lighting package 302, the socket housing 306, and the thermal management structure 308 together define an individual socket 310 of the assembly 300. Any number of sockets 310 may be combined to form the assembly 300. In the illustrated embodiment, three sockets 310 are ganged together, such that the sockets 310 are mechanically and electrically coupled to one another.

Each lighting package 302 includes a lighting printed circuit board (PCB) 312 received in the receptacle 304. The lighting PCBs 312 have electronic components 314 mounted thereto. Optionally, the electronic components 314 may be LEDs 316. The electronic components 314 may additionally or alternatively include microprocessors, capacitors, circuit protection devices, resistors, transistors, integrated circuit, and the like that create an electronic circuit or control circuit with a particular control function (e.g. wireless control, filtering, circuit protection, light control, and the like).

As shown in FIG. 5, the lighting PCB 312 includes a power interface 320 and a thermal interface 322. The power interface 320 engages power contacts 324 held by the socket housing 306. Power is transferred across the power interface 320 to power the electronic components 314 (shown in FIG. 4). In the illustrated embodiment, the power interface 320 includes a plurality of power pads 326 on a bottom surface 328 of the lighting PCB 312 that interface with corresponding power contacts 324.

The thermal interface 322 engages the thermal management structure 308, which is held by the socket housing 306 at a bottom of the receptacle 304. In the illustrated embodiment, the thermal management structure 308 is represented by a heat slug, which is a solid metal block held by the socket housing 306 and that extends to a bottom 330 of the socket housing 306. Optionally, a bottom of the thermal management structure 308 may flare out to have a larger surface area than a top of the thermal management structure 308. The bottom of the thermal management structure 308 engages the heat sink when the socket housing 306 is mounted thereto. The top of the thermal management structure 308 defines a mating interface 332 that engages the thermal interface 322 when the LED PCB 312 is loaded into the receptacle 304.

The socket housing 306 includes a first mating end 334 and an opposite second mating end 336. In an exemplary embodiment, the mating ends 334, 336 are hermaphroditic. The mating ends 334, 336 having separable mating interfaces, which may be substantially identical to one another such that the first mating end 334 is configured to mate with either the first or second mating end 334, 336 of an adjacent socket 310. In an exemplary embodiment, the mating ends 334, 336 include hooks 338 on one side thereof and pockets 340 on the other side thereof. The hooks 338 are configured to be received in the pockets 340 of an adjacent socket 310.

The socket housing 306 includes a plurality of the power contacts 324 at each of the mating ends 334, 336 exposed on the exterior edges of the socket housing 306. The power contacts 324 extend into the receptacle 304 for mating with the lighting PCB 312. The power contacts 324 may be compliant beams that deflect when engaging corresponding power pads 326, or corresponding power contacts 324 of an adjacent socket 310. The socket housing 306 may include fasteners to secure the socket housing 306 to the heat sink. Once secured, the lighting PCB 312 may be removed from the receptacle 304 and replaced with a different lighting PCB 312.

With reference to FIG. 4, the sockets 310 may be assembled together prior to being mounted to the heat sink. For example, the thermal management structure 308 may be coupled to the socket housing 306, and then the lighting package 302 loaded into the receptacle 304. Once assembled, the socket 310 may be handled as a single unit, and moved to the appropriate location on the heat sink and mounted thereto. As a result, the thermal management structure 308 is an integral part of the socket 310 and may be mounted to the heat sink during the same mounting step as the socket housing 306. Once mounted, the thermal management structure 308 engages the heat sink and defines the thermal path between the lighting package 302 and the heat sink.

A power connector 342 may be coupled to either mating end 334, 336 rather than an adjacent socket 310. For example, the socket 310 arranged at the upstream end of the assembly 300 may be connected to a power connector 342. The power connector 342 supplies power to the assembly 300, such as from a power source. The power connector 342 may be connected to the sockets 310 either before or after the sockets 310 are mounted to the heat sink.

Figure 6:
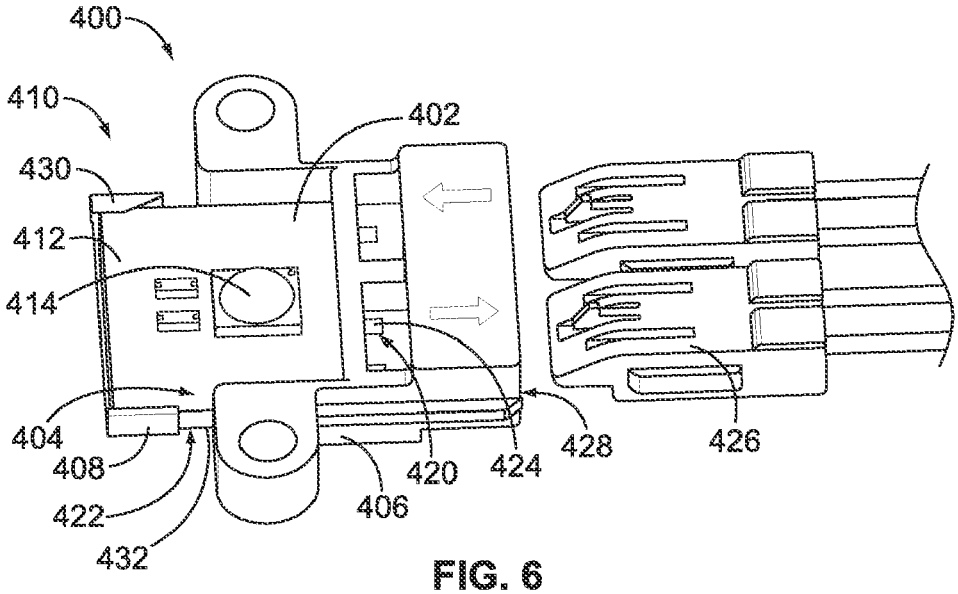
FIG. 6 is a top perspective view of yet another alternative socket assembly formed in accordance with an exemplary embodiment.
Figure 7:
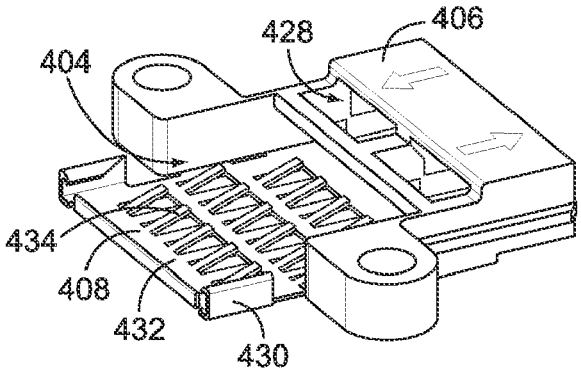
FIG. 7 is a top perspective view of a socket housing and thermal management structure for the socket assembly shown in FIG. 6.

FIG. 6 is a top perspective view of yet another alternative socket assembly 400 formed in accordance with an exemplary embodiment. FIG. 7 is a top perspective view of a portion of the socket assembly 400. The assembly 400 includes a lighting package 402 that is removably received in a receptacle 404 of a socket housing 406. A thermal management structure 408 is coupled to the socket housing 406 and is positioned at the receptacle 404 in thermal engagement with the lighting package 402. The thermal management structure 408 is configured to engage a heat sink (not shown) to dissipate heat from the lighting package 402 to the heat sink.

The lighting package 402, the socket housing 406, and the thermal management structure 408 together define an individual socket 410 of the assembly 400. Any number of sockets 410 may be combined to form the assembly 400, such as by being ganged or daisy-chained together.

The lighting package 402 includes a lighting printed circuit board (PCB) 412 received in the receptacle 404. The lighting PCB 412 has one or more electronic components 414 mounted thereto. Optionally, the electronic component 414 may be an LED. The electronic component 414 may additionally or alternatively include one or more of microprocessors, capacitors, circuit protection devices, resistors, transistors, integrated circuit, and the like that create an electronic circuit or control circuit with a particular control function (e.g. wireless control, filtering, circuit protection, light control, and the like).

The lighting PCB 412 includes a power interface 420 and a thermal interface 422. The power interface 420 includes power contacts 424 that interface with corresponding contacts (not shown) of a power connector 426. Power is transferred across the power interface 420 to power the electronic components 414. The power connectors 426 are received in corresponding connector ports 428 in the socket housing 406 to mate directly to the lighting PCB 412.

The thermal interface 422 engages the thermal management structure 408, which is held by the socket housing 406 at a bottom of the receptacle 404. In the illustrated embodiment, the thermal management structure 408 is represented by a metal plate attached to the socket housing 406 at a bottom of the receptacle 406. The thermal management structure 408 forms part of the receptacle 406. Optionally, the thermal management structure 408 may include supporting elements 430 in the form of walls and/or latches that support the lighting PCB 412. The thermal management structure 408 also includes a base 432 that extends along the bottom of the receptacle 404. The base 432 supports the lighting PCB 412 from below. The base 432 includes a plurality of fingers 434 that extend upward from the base 432 into the receptacle 404. The fingers 434 are compliant beams that deflect when the lighting PCB 412 is loaded into the receptacle 404. The fingers 434 are biased against the lighting PCB 412 and maintain thermal engagement with the lighting PCB 412 when the lighting PCB 412 is loaded into the receptacle 404. Heat is transferred to the base 432 by the fingers 434. The base 432 engages the heat sink when the socket housing 406 is mounted thereto. Optionally, the base 432 may also include fingers that extend downward and engage the heat sink.

In the illustrated embodiment, two electrical power connectors 426 are coupled to the individual socket 410. One of the power connectors 426 brings power into the socket 410, such as from a power source or from another upstream socket 410. The other power connector 426 takes power out of the socket 410, such as to a downstream socket 410. The power connectors 426 are provided at cable ends. Any number of sockets 410 may be provided and electrically connected using the power connectors 426 and corresponding cables to form the assembly 400. The sockets 410 may be assembled together prior to being mounted to the heat sink. For example, the thermal management structure 408 may be coupled to the socket housing 406, and then the lighting package 402 loaded into the receptacle 404. Once assembled, the socket 410 may be handled as a single unit, and moved to the appropriate location on the heat sink and mounted thereto. As a result, the thermal management structure 408 is an integral part of the socket 410 and may be mounted to the heat sink during the same mounting step as the socket housing 406. Once mounted, the thermal management structure 408 engages the heat sink and defines the thermal path between the lighting package 402 and the heat sink. The power connectors 426 may be connected to the sockets 410 either before or after the sockets 410 are mounted to the heat sink.

Figure 8:
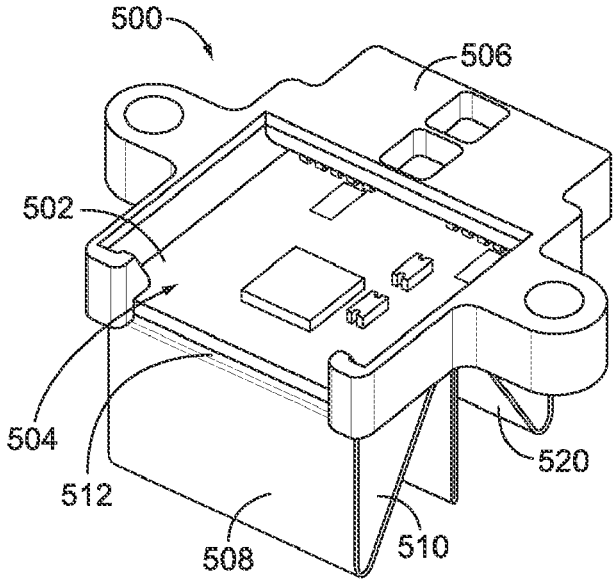
FIG. 8 is a bottom perspective view of another alternative socket assembly formed in accordance with an exemplary embodiment.

FIG. 8 is a top perspective view of yet another alternative socket assembly 500 formed in accordance with an exemplary embodiment. The assembly 500 includes a lighting package 502 that is removably received in a receptacle 504 of a socket housing 506. A thermal management structure 508 is coupled to the socket housing 506 and is positioned at the receptacle 504 in thermal engagement with the lighting package 502. The lighting package 502 and socket housing 506 are similar to the lighting package 402 and socket housing 406 (both shown in FIGS. 6 and 7), however the thermal management structure 508 differs from the thermal management structure 308 (shown in FIGS. 6 and 7).

The thermal management structure 508 includes an integral heat sink 510 extending therefrom. The thermal management structure 508 includes a base 512 and fingers (not shown, but similar to the fingers 434 shown in FIG. 7) that extend upward and/or downward from the base 512 to engage the lighting package 502. The base 512 may include mounting features (not shown) that engage the socket housing 506 to securely couple the thermal management structure 508 to the socket housing 506. For example, the mounting features may extend into slots in the bottom of the socket housing 506 and engage the socket housing 506 in an interference fit to secure the thermal management structure 508 to the socket housing 506.

The heat sink 510 is positioned below the base 512. In an exemplary embodiment, the heat sink 510 is formed integral with the base 512. For example, both the base 512 and the heat sink 510 are stamped and formed from a common piece of metal. The heat sink 510 is formed and shaped to facilitate heat dissipation therefrom. In an exemplary embodiment, the heat sink 510 includes a plurality of fins 520 that are angled with respect to the base 512. The fins 520 may be angled perpendicular to the base 512 or at non-orthogonal angles with respect to the base 512. The heat sink 512 has an overall surface area that is greater than the surface area of the base 512. In the illustrated embodiment, the surface area of the heat sink 510 is approximately 5 times the surface area of the base 512, with each fin 520 having a first side and a second side, and with 5 total number of fins 520 being provided. The surface area of one side of each fin 520 is approximately half the surface area of the base 512. It is realized that any number of fins 520 may be provided in alternative embodiments. Additionally, the fins 520 may have any relative size compared to the base 512.

Figure 9:
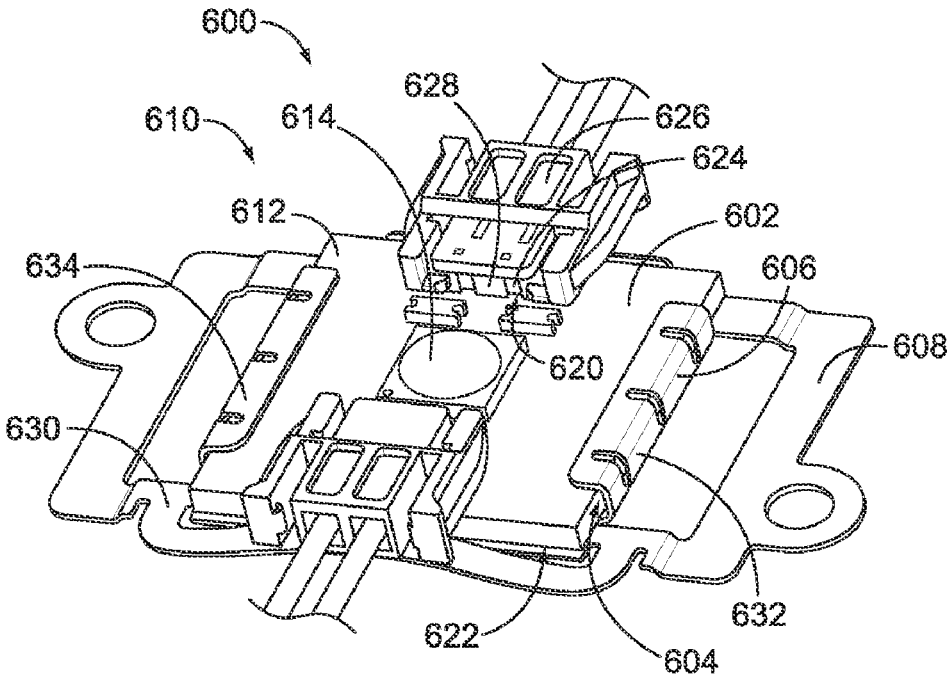
FIG. 9 is a top perspective view of yet another alternative socket assembly formed in accordance with an exemplary embodiment.
Figure 10:
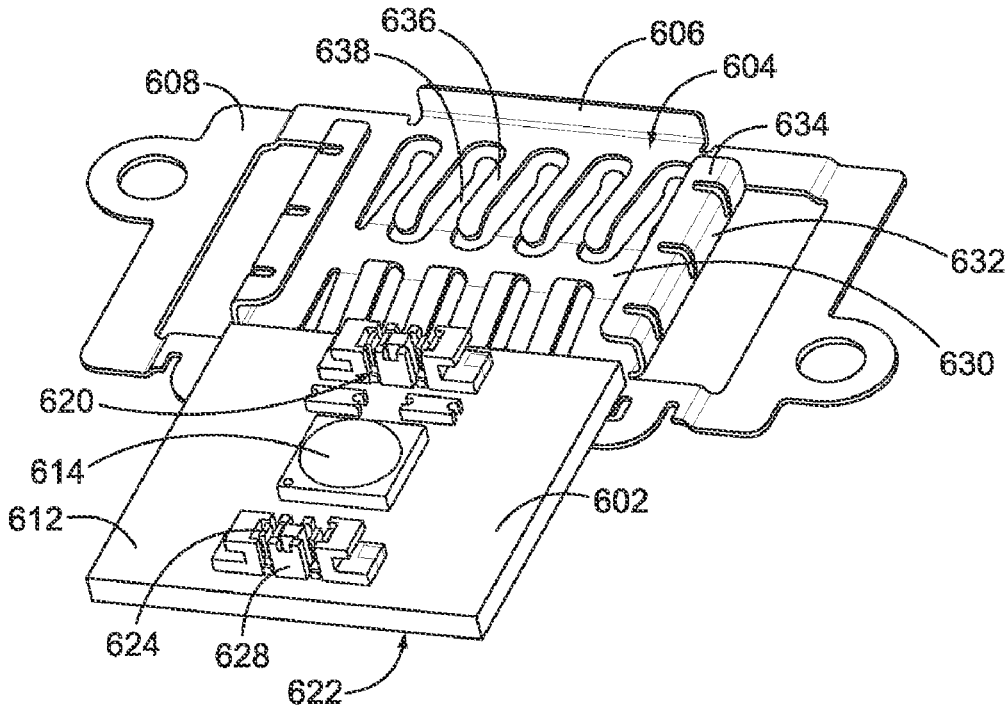
FIG. 10 is a top perspective view of a thermal management structure for the socket assembly shown in FIG. 9.

FIG. 9 is a top perspective view of another alternative socket assembly 600 formed in accordance with an exemplary embodiment. FIG. 10 is an exploded view of the socket assembly. The assembly 600 includes a lighting package 602 that is removably received in a receptacle 604 of a socket housing 606. A thermal management structure 608 defines the socket housing 606 and receptacle 604. The thermal management structure 608 is in thermal engagement with the lighting package 602. The thermal management structure 608 is configured to engage a heat sink (not shown) to dissipate heat from the lighting package 602 to the heat sink.

The lighting package 602 and the thermal management structure 608 together define an individual socket 610 of the assembly 600. Any number of sockets 610 may be combined to form the assembly 600, such as by being ganged or daisy-chained together.

The lighting package 602 includes a lighting printed circuit board (PCB) 612 received in the receptacle 604. The lighting PCB 612 has one or more electronic components 614 mounted thereto. Optionally, the electronic component 614 may be an LED. The electronic component 614 may additionally or alternatively include one or more of microprocessors, capacitors, circuit protection devices, resistors, transistors, integrated circuit, and the like that create an electronic circuit or control circuit with a particular control function (e.g. wireless control, filtering, circuit protection, light control, and the like).

The lighting PCB 612 includes one or more power interface(s) 620 and a thermal interface 622. Each power interface 620 includes power contacts 624 that interface with corresponding contacts (not shown) of a power connector 626. Power is transferred across the power interface 620 to power the electronic components 614. The power contacts 624 are held in a connector body 628 that is mounted to the lighting PCB 612. The power connector 626 is coupled to the connector body 628 such that mating contacts (not shown) of the power connector 626 engage the power contacts 624.

The thermal interface 622 engages the thermal management structure 608. In the illustrated embodiment, the thermal management structure 608 is represented by a metal plate, which may be stamped and formed to include a base 630 and a plurality of supporting elements 632 extending from the base 630. The supporting elements 632 represent walls that form the socket housing 606 and that define a space defining the receptacle 604. As such, the socket housing 606 is formed integral with the thermal management structure 608. The thermal management structure 608 is the structure defining the receptacle 604, as opposed to dielectric body defining the receptacle. The supporting elements 632 may include latches 634 that secure the lighting PCB 612 within the receptacle 604. The base 630 extends along the bottom of the receptacle 604. The base 630 supports the lighting PCB 612 from below. The base 630 includes a plurality of package fingers 636 that extend upward from the base 630 into the receptacle 604 and a plurality of heat sink fingers 638 that extend downward from the base 630. The package fingers 636 engage the lighting PCB 612 and the heat sink fingers 638 engage the heat sink. The fingers 636, 638 are compliant beams that deflect when loaded against the lighting PCB 612 and heat sink, respectively. The fingers 636, 638 are biased against the lighting PCB 612 and heat sink, respectively, and maintain thermal engagement when the lighting PCB 612 is loaded into the receptacle 604 and when the socket 610 is mounted to the heat sink. Heat is transferred to the base 630 by the package fingers 636, and the heat is transferred from the base 630 to the heat sink by the heat sink fingers 638. Optionally, an equal number of package fingers 636 and heat sink fingers 638 may be provided. Alternatively, an unequal number of fingers 636, 638 may be provided. The fingers 636, 638 may be the same size, or alternatively, may be sized differently. Optionally, the fingers 636 may provide substantially the same biasing force upward as the downward biasing force of the fingers 638.

In the illustrated embodiment, two electrical power connectors 626 are coupled to the individual socket 610. One of the power connectors 626 brings power into the socket 610, such as from a power source or from another upstream socket 610. The other power connector 626 takes power out of the socket 610, such as to a downstream socket 610. The power connectors 626 are provided at cable ends. Any number of sockets 610 may be provided and electrically connected using the power connectors 626 and corresponding cables to form the assembly 600. The sockets 610 may be assembled together prior to being mounted to the heat sink. For example, the lighting package 602 may be loaded into the receptacle 604 of the thermal management structure 608 and handled as a single unit, and moved to the appropriate location on the heat sink and mounted thereto. Once mounted, the thermal management structure 608 engages the heat sink and defines the thermal path between the lighting package 602 and the heat sink. The power connectors 626 may be connected to the sockets 610 either before or after the sockets 610 are mounted to the heat sink.

Figure 11:
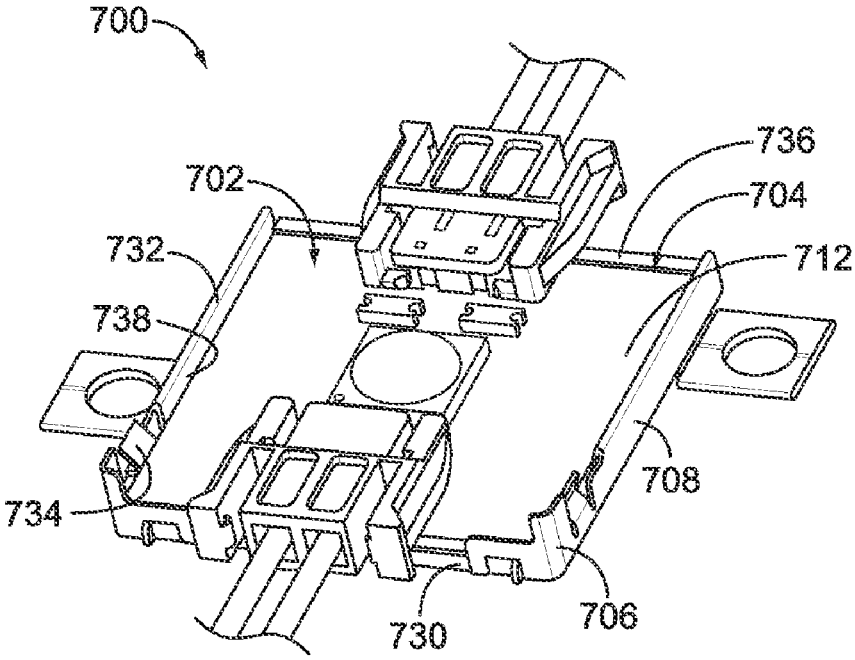
FIG. 11 is a top perspective view of another alternative socket assembly formed in accordance with an exemplary embodiment.
Figure 12:
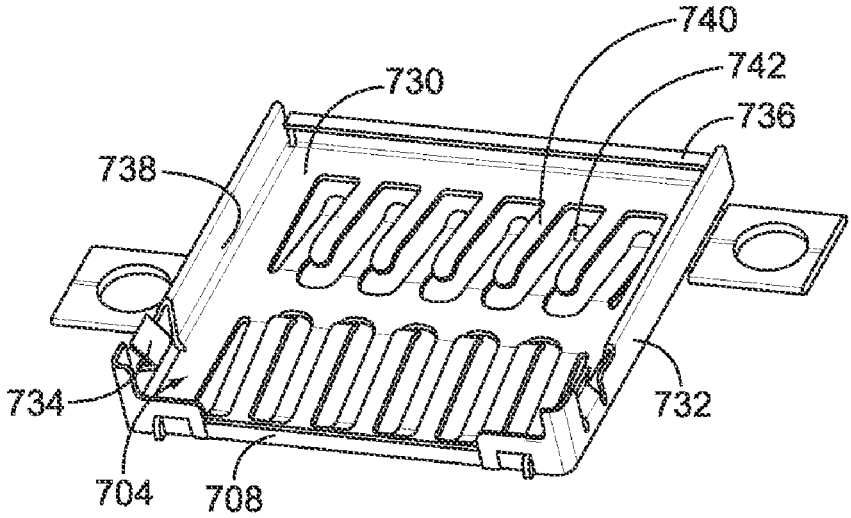
FIG. 12 is a top perspective view of a socket housing and thermal management structure for the socket assembly shown in FIG. 11.

FIG. 11 is a top perspective view of another alternative socket assembly 700 formed in accordance with an exemplary embodiment. FIG. 12 is an exploded view of the socket assembly. The assembly 700 includes a lighting package 702 that is removably received in a receptacle 704 of a socket housing 706. A thermal management structure 708 defines the socket housing 706 and receptacle 704. The thermal management structure 708 is in thermal engagement with the lighting package 702. The thermal management structure 708 is configured to engage a heat sink (not shown) to dissipate heat from the lighting package 702 to the heat sink. The thermal management structure 708 is similar to the thermal management structure 608 (shown in FIGS. 9 and 10), however the thermal management structure 708 includes different structural features.

The thermal management structure 708 includes a base 730 and a plurality of supporting elements 732 extending from the base 730. The supporting elements 732 represent walls that form the socket housing 706 and that define a space defining the receptacle 704. As such, the socket housing 706 is formed integral with the thermal management structure 708. The thermal management structure 708 is the structure defining the receptacle 704. The supporting elements 732 may include latches 734 that secure the lighting PCB 712 within the receptacle 704. At least one of the supporting elements 732 includes a ledge 736. The lighting package 702 is received under the ledge 736 to hold the lighting package 702 within the receptacle 704. In the illustrated embodiment, the supporting elements 732 extending along the sides of the lighting package 702 include deflectable thermal arms 738 that engage the sides of the lighting package 702. The thermal arms 738 are in thermal engagement with the sides to dissipate heat from the lighting package 702. Optionally, the sides of the lighting package 702 may be plated to improve thermal conductivity along the sides thereof.

The base 730 extends along the bottom of the receptacle 704. The base 730 supports the lighting package 702 from below. The base 730 includes a plurality of package fingers 740 that extend upward from the base 730 into the receptacle 704 and a plurality of heat sink fingers 742 that extend downward from the base 730. The package fingers 740 engage the lighting package 702 and the heat sink fingers 742 engage the heat sink.

Figure 13:
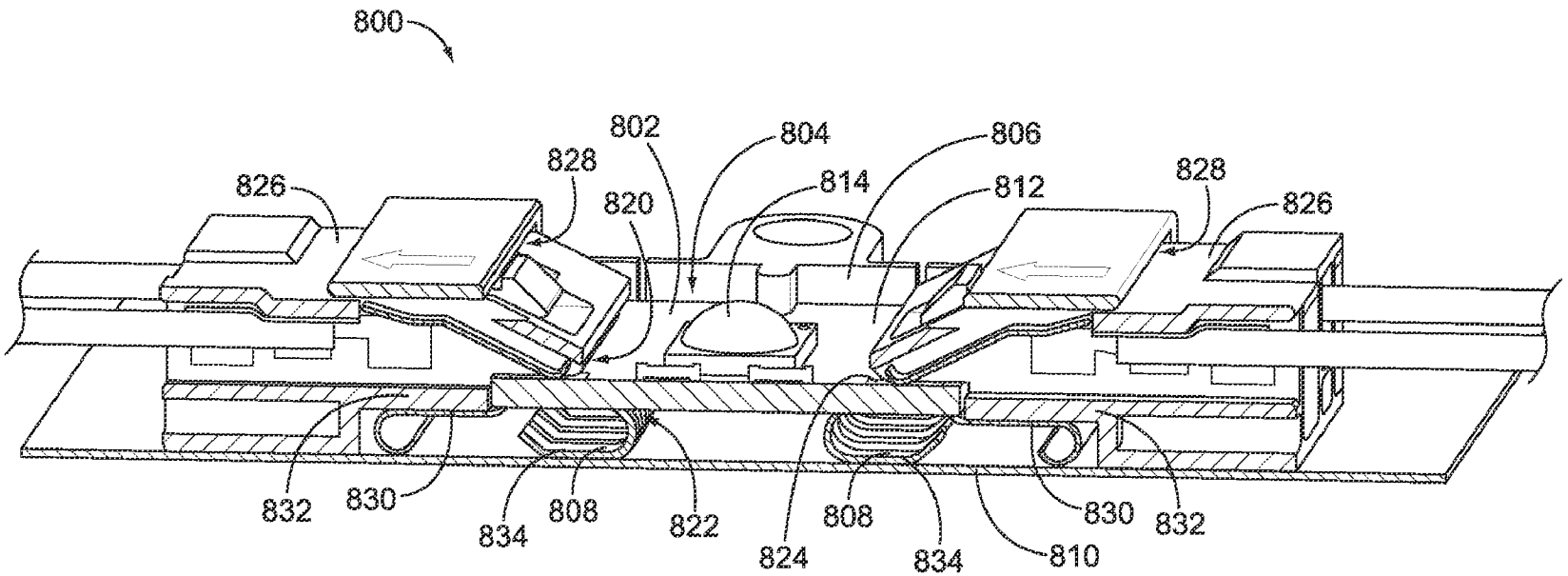
FIG. 13 is a partial cutaway view of an alternative socket assembly formed in accordance with an exemplary embodiment.

FIG. 13 is a partial cutaway view of yet another alternative socket assembly 800 formed in accordance with an exemplary embodiment. The assembly 800 includes a lighting package 802 that is removably received in a receptacle 804 of a socket housing 806. A thermal management structure 808 is coupled to the socket housing 806 and is positioned at the receptacle 804 in thermal engagement with the lighting package 802. The thermal management structure 808 is configured to engage a heat sink 810 to dissipate heat from the lighting package 802 to the heat sink 810.

The lighting package 802 includes a lighting printed circuit board (PCB) 812 received in the receptacle 804. The lighting PCB 812 has one or more electronic components 814 mounted thereto. Optionally, the electronic component 814 may be an LED. The electronic component 814 may additionally or alternatively include one or more of microprocessors, capacitors, circuit protection devices, resistors, transistors, integrated circuit, and the like that create an electronic circuit or control circuit with a particular control function (e.g. wireless control, filtering, circuit protection, light control, and the like).

The lighting PCB 812 includes a power interface 820 and a thermal interface 822. The power interface 820 includes power contacts 824 that interface with corresponding mating contacts 825 of power connectors 826. Power is transferred across the power interface 820 to power the electronic components 814. The power connectors 826 are received in corresponding connector ports 828 in the socket housing 806 to mate directly to the lighting PCB 812.

The thermal interface 822 engages the thermal management structure 808, which is held by the power connectors 826 at a bottom of the receptacle 804. In the illustrated embodiment, the thermal management structure 808 is represented by a metal base 830 attached to a dielectric body 832 of the power connector 826. The thermal management structure 808 includes fingers 834 extending forward of the base 830. The fingers 834 engage the bottom of the lighting PCB 812 at the thermal interface 822. The fingers 834 are compliant beams that deflect when mated with the lighting PCB 812 to ensure good thermal engagement against the bottom of the lighting PCB 812. When the power connector 826 is mated with the socket housing 806, the fingers 834 are biased against the heat sink 810 and maintain thermal engagement with the heat sink 810. Heat is transferred by the fingers 834 from the thermal interface 822 to the heat sink 810 when the power connector 826 is plugged into the socket housing 806.

In the illustrated embodiment, two power connectors 826 are coupled to the individual socket housing 806. One of the power connectors 826 brings power into the socket housing 806, such as from a power source or from another upstream socket housing 806. The other power connector 826 takes power out of the socket housing 806. The power connectors 826 are provided at cable ends. Any number of socket housings 806 and lighting packages 802 may be provided and electrically connected using the power connectors 826 and corresponding cables to form the assembly 800. The thermal management structure 808 is an integral part of the power connectors 826 and is connected to the lighting PCB 812 when the power connector 826 is coupled to the socket housing 806. Once mated, the thermal management structure 808 engages the heat sink 810 and defines the thermal path between the lighting package 802 and the heat sink 810.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A socket assembly comprising:

a lighting package;

a socket housing having a receptacle that removably receives the lighting package, the socket housing being manufactured from a dielectric material, the socket housing holding power contacts that engage the lighting package to power the lighting package; and a thermal management structure coupled to the socket housing, the thermal management structure having a lighting package interface engaging the lighting package and a heat sink interface configured to engage a heat sink, the thermal management structure creating a continuous metal path between the lighting package interface and the heat sink interface, the thermal management structure being positioned at the receptacle in thermal engagement with the lighting package, the thermal management structure being configured to engage a heat sink to dissipate heat from the lighting package to the heat sink along the continuous metal path;

wherein the lighting package includes a bottom facing the heat sink, the thermal management structure includes fingers engaging the bottom of the lighting package and dissipating heat from the lighting package.

2. The assembly of claim 1, wherein at least one of the socket housing and the thermal management structure includes mounting features configured to mount the socket assembly to a heat sink, the lighting package being removable from the receptacle while the socket assembly remains mounted to the heat sink.

3. The assembly of claim 1, wherein the socket housing has an open bottom, the thermal management structure is coupled to the bottom of the socket housing such that the thermal management structure is positioned directly between the lighting package and the heat sink, the thermal management structure and the socket housing are coupled to a heat sink as a unit.

4. The assembly of claim 1, wherein the thermal management structure includes package fingers engaging the lighting package and heat sink fingers being configured to engage a heat sink, the thermal management structure dissipating heat from the lighting package to the heat sink.

5. The assembly of claim 1, wherein the lighting package includes a light emitting diode (LED), the thermal management structure includes latches holding the LED within the receptacle, the thermal management structure engaging the LED to dissipate heat from the LED.

6. The assembly of claim 1, wherein the lighting package includes a lighting printed circuit board (PCB) having a power circuit, the socket housing having latches holding the lighting PCB in the receptacle, the thermal management structure engaging the lighting PCB to dissipate heat from the lighting PCB.

7. The assembly of claim 1, wherein the receptacle has an open top and an open bottom, the thermal management structure positioned at the open bottom to engage a bottom of the lighting package in the receptacle, the thermal management structure including arms engaging sides of the lighting package and a top of the lighting package to dissipate heat from the sides and top of the lighting package.

8. The assembly of claim 1, wherein the thermal management structure having a heat sink opposite the mating interface that is formed integral with the mating interface, the heat sink having fins having a total surface area at least twice a surface area of the mating interface.

9. The assembly of claim 1, further comprising a power connector coupled to the socket housing, the power connector having power contacts engaging the lighting package to supply power to the lighting package, the thermal management structure being coupled to the power connector, wherein the thermal management structure is coupled to the socket housing with the power connector.

10. A socket assembly comprising:

a first socket comprising a first socket housing having a first receptacle and a first connector, the first socket housing being manufactured from a dielectric material, the first socket comprising a first lighting package removably received in the first receptacle and electrically connected to the first connector, the first socket comprising a first thermal management structure coupled to the first socket housing, the first thermal management structure being positioned at the first receptacle in thermal engagement with the first lighting package, the first thermal management structure having a lighting package interface engaging the first lighting package and a heat sink interface configured to engage a heat sink, the first thermal management structure creating a continuous metal path between the lighting package interface and the heat sink interface of the first thermal management structure; and a second socket comprising a second socket housing having a second receptacle and a second connector, the second socket housing being manufactured from a dielectric material, the second socket comprising a second lighting package removably received in the second receptacle and electrically connected to the second connector, the second socket comprising a second thermal management structure coupled to the second socket housing, the second thermal management structure being positioned at the second receptacle in thermal engagement with the second lighting package, the second thermal management structure having a lighting package interface engaging the second lighting package and a heat sink interface configured to engage a heat sink, the second thermal management structure creating a continuous metal path between the lighting package interface and the heat sink interface of the second thermal management structure;

wherein the first and second sockets are ganged together such that the first and second connectors are electrically connected to one another to transfer power between the first and second sockets;

wherein the first and second lighting packages have bottoms facing the corresponding heat sink, the first and second thermal management structures include fingers engaging the bottoms of the first and second lighting packages, respectfully, for dissipating heat from the first and second lighting packages.

11. The assembly of claim 10, wherein the first connector includes first mating contacts held by the first socket housing, the first mating contacts being exposed within the receptacle and engaging the first lighting package, and wherein the second connector includes second mating contacts held by the second socket housing, the second mating contacts being exposed within the receptacle and engaging the second lighting package.

12. The assembly of claim 10, wherein the first connector includes first mating contacts held by the first socket housing, the first mating contacts being exposed within the receptacle, the first lighting package having a first printed circuit board (PCB) with first power contacts thereon, the first power contacts engaging the first mating contacts.

13. The assembly of claim 10, further comprising a first power connector mated to the first connector, the first power connector transferring power to the first lighting package, the power supplied to the first lighting package being transferred to the first connector by the first lighting package, the power supplied to the first connector being transferred to the second connector by the first connector.

14. The assembly of claim 10, wherein the first lighting package includes a lighting printed circuit board (PCB) having a light emitting diode (LED) mounted to the lighting PCB, the first socket housing having latches holding the lighting PCB in the first receptacle, the first thermal management structure engaging the lighting PCB to dissipate heat from the lighting PCB.

15. A socket assembly comprising:

a lighting package having a lighting printed circuit board (PCB) with a power circuit having a power contact, the power contact being configured to receive power from a power source to power the power circuit, the lighting PCB having a bottom and a top opposite the bottom, an LED being mounted to the top;

a thermal management structure defining at least a portion of a socket housing, the socket housing having a receptacle that removably receives the lighting package, the thermal management structure having a mating interface in thermal engagement with the lighting package, the thermal management structure having fingers at the mating interface engaging the bottom of the lighting PCB directly below the LED, the thermal management structure being configured to dissipate heat directly to a heat sink from the lighting PCB;

wherein the thermal management structure includes a base and latches extending upward from the base, the base extending along a bottom of the receptacle and engaging the lighting package to dissipate heat from the lighting package, the latches extending along sides of the the receptacle and engaging the lighting package to hold the lighting package in the receptacle.

16. The assembly of claim 15, wherein the thermal management structure has a heat sink opposite the mating interface, the heat sink having fins having a total surface area at least twice a surface area of the mating interface, the heat sink being formed integral with the mating interface.

* * * * *